United States Patent [19]

Fernandez

[11] 4,033,589

[45] July 5, 1977

[54] BINGO INSTRUMENT

[76] Inventor: John F. Fernandez, 2-106th Ave., Elmont, N.Y. 11003

[22] Filed: Jan. 9, 1976

[21] Appl. No.: 638,781

[52] U.S. Cl. ..... 273/148 R; 294/65.5
[51] Int. Cl.² ..... A63F 9/00
[58] Field of Search ..... 273/148 R, 135 B; 81/302; 269/8, 96; 294/65.5

[56] References Cited

UNITED STATES PATENTS

| | | | |
|---|---|---|---|
| 2,426,795 | 9/1947 | Sjostrom | 294/65.5 X |
| 2,970,003 | 1/1961 | Heath, Jr. et al. | 273/148 R X |

FOREIGN PATENTS OR APPLICATIONS

| | | | |
|---|---|---|---|
| 738,193 | 10/1955 | United Kingdom | 294/65.5 |

*Primary Examiner*—Anton O. Oechsle

[57] ABSTRACT

A tool for use by bingo players who play lap board bingo; the tool serving to pick up the metal chips very quickly after a game in order to be ready for the next game; the tool including a pair of levers pivotally together at the center so that one end of the levers form handles that may be squeezed together, the opposite ends of the levers each having a plate that rests against each other when the jaws are closed, one of the plates being magnetic and the other a cardboard. The handle having the cardboard plate secured thereto may incorporate a hopper into which the chips may drop after being released by separation of the plates.

1 Claim, 3 Drawing Figures

10
11
15
17
13
14
16
18
19
12

10
11
15
17
13
14
MAGNETIC PLATE
18
16
12
19
19

18
17
20
19
21
16
23
22

BINGO INSTRUMENT

This invention relates generally to equipment for bingo players.

It is generally well known among bingo players that bingo games are played rapidly one after another, so that a relatively large number of them may be played at a single sitting. This, therefore, necessitates the players to quickly pick up their playing pieces after each game, and clear the bingo board so to be ready for a next game. This taxes the players speed so to be ready. This situation is accordingly therefore in want of an improvement.

Accordingly it is the principal object of the present invention to provide a bingo instrument that is designed for use only on lap board bingo, and which quickly and easily picks up the metal chips from the board so that the person has time for being ready for a following game.

Another object of the present invention is to provide a bingo instrument which quickly collects all of the metal chips by magnet means so that a single sweep of the tool across the lap board will thus quickly pick up all of the metal chips and remove the same.

Still another purpose of the present invention is to provide a bingo instrument wherein the picked up metal chips are quickly and instantly released from the bingo instrument after being carried off the lap board so that the instrument can then be put down while the collected metal chips are all dropped together in a same place, readly for reuse.

Other objects are to provide a bingo instrument which is simple in design, inexpensive to manufacture, rugged in construction, easy to use and efficient in operation.

These and other objects will be readily evident upon a study of the following specification and accompanying drawings, wherein.

Figure 1:
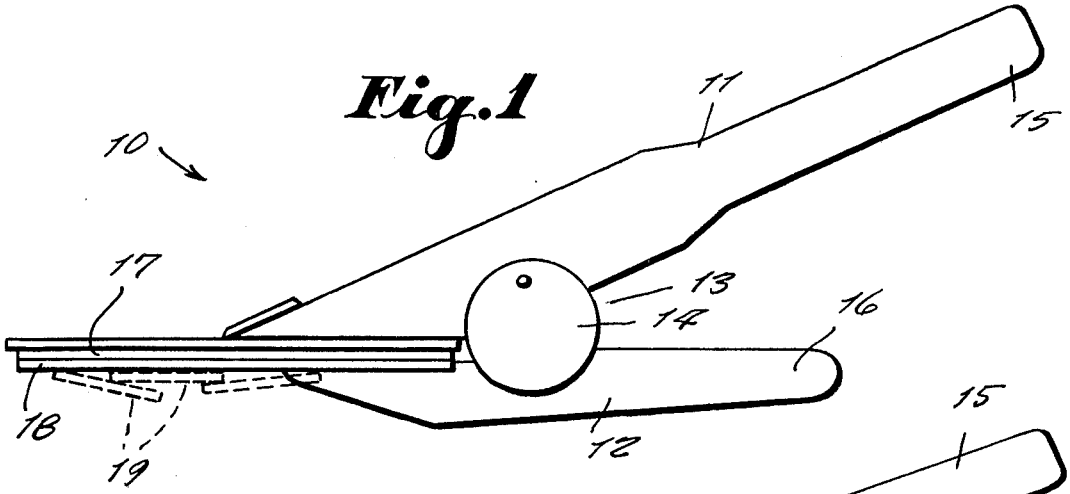
FIG. 1 is a side elevation view of the bingo instrument, and showing it having picked up metal chips which are magnetically attached thereto.
Figure 2:
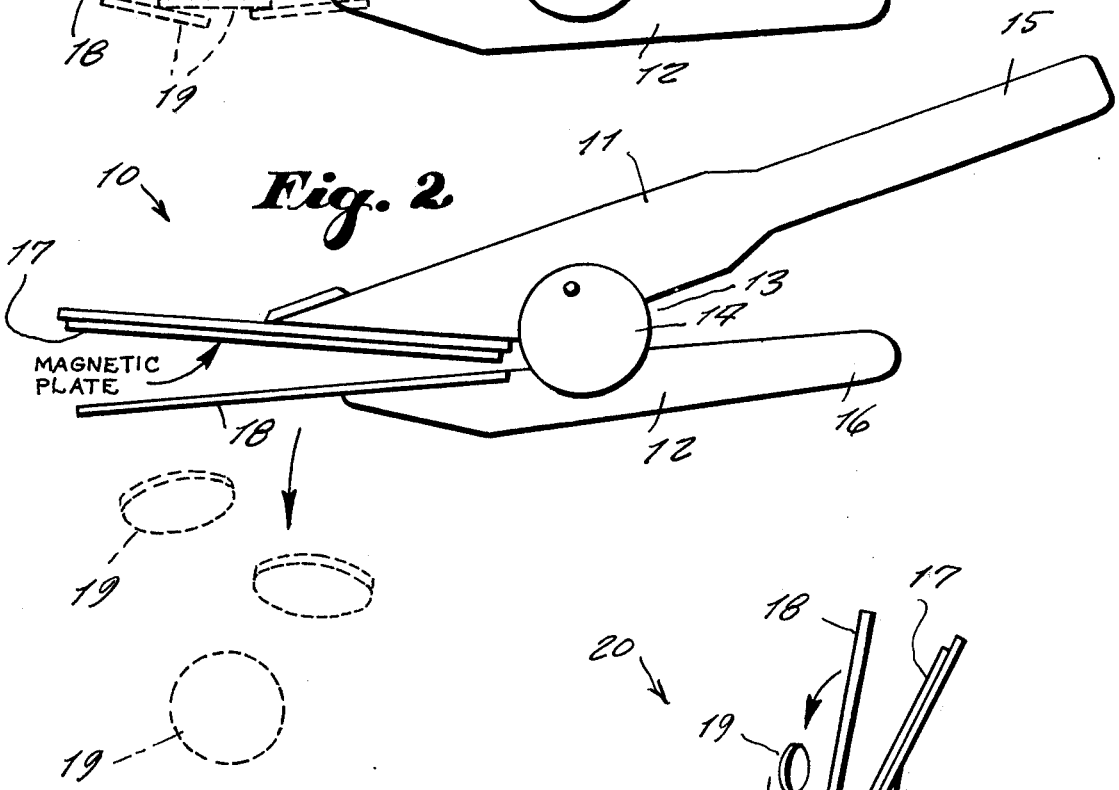
FIG. 2 is a view similar to FIG. 1, and showing the bingo instrument in a position for instantly releasing the metal chips.

Referring now to the drawing in greater detail, and more particularly to FIGS. 1 and 2 thereof, the reference numeral 10 represents a bingo instrument according to the present invention wherein there are a pair of levers 11 and 12 which are pivotable respective to each other along a longitudinal center portion thereof wherein there is a fulcrum 13 that includes a disc 14 of round shape having a spring clip therewithin. The lever 11 has a relatively long handle 15 at one end and which can be squeezed together with a handle 16 of short length upon the other lever 12 when the handles are held together in a person's hand.

The opposite end of the lever 11 has a magnetic plate 17 secured thereto which comprises a permanent magnet so that it will attract steel objects. The other lever 12 has a cardboard plate 18 secured thereto, the plates 17 and 18 being parallel to each other when the handles are released so that the levers pivot about the fulcrum 13, as shown in FIG. 1. It is to be noted that each of the levers are preferably made of a molded plastic material in order to be inexpensive and so as to not become magnetized and thus interfere with the normal operation of the magnetic plate 17.

While the present invention is not limited to specific sizes, it is suggested for practical purposes that the magnetic plate be 3 × 4 inches in size, the cardboard plate 18 being of the corresponding same dimensions, the long handle 15 being 5 ¾ inches in length while the short handle is 3 ½ inches in length.

In operative use, as shown in FIGS. 1 and 2, the bingo instrument 10 can be used to quickly pick up all of the metal chips 19 by simply passing the instrument over the bingo lap board, the instrument being in the position shown in FIG. 1 wherein the cardboard plate in adjacent the magnetic plate. In this position, the magnetic forces from the magnetic plate pass through the cardboard plate so that as the instrument is passed over the bingo lap board with the cardboard plate facing the metal chips, the metal chips will leave the lap board and cling to the underside of the cardboard plate due to the magnetic forces being present in this area. The instrument having thus picked up the metal chips, is then carried off the lap board and positioned over a box or other area where the metal chips are to be released. In order to release the metal chips from the instrument, the person simply squeezes the handles 15 and 16 together, as shown in FIG. 2, thus causing the cardboard plate to separate from the magnetic plate, the cardboard plate leaves the area where the magnetic forces are present so that the metal chips then drop away from the cardboard plate, as shown in FIG. 2.

Thus the metal chips are quickly cleared from a lap board and deposited elsewhere.

Figure 3:
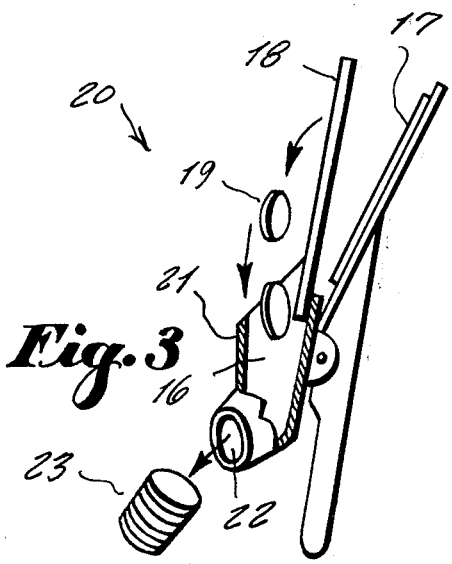
FIG. 3 is a side view, partly in cross section, and showing a modified design of the invention which additionally includes a hopper incorporated therewith through which the released metal chips are dispensed from the instrument so that the metal chips fall out already stacked.

Reference is now made to FIG. 3 of the drawing wherein there is a modified design of the drawing and which incorporates all of the above described features of instrument 10. In FIG. 3, the instrument 20 additionally includes beside all of the above described features, a hopper 21 being formed alongside the short handle 16, so that if the instrument is tilted upwardly as shown in FIG. 3, when the handles are squeezed together, the metal chips dropping from the cardboard plate will thus drop down into the open end of the hopper 21, the hopper being convergingly narrowed towards its lower end so that the metal chips falling into the hopper thus become stacked together and dropping outwardly of a rear opening 22 of the hopper, the chips coming out in a stack 23 as shown. This form of the invention thus eliminates the necessity of a person picking up the released chips and stacking them by hand. If the stack of chips are released into a person's palm, he additionally saves time because they are already in place for being used in a following game.

While various changes may be made in the detail construction, it is understood that such changes will be within the spirit and scope of the present invention as is defined by the appended claims.

What I now claim is:

1. A bingo instrument comprising in combination a pair of levers made preferably of rigid plastic material, said levers being pivotally attached together at their intermediate longitudinal portions about a common fulcrum, one end of said levers forming handles which can be squeezed together when held in a person's hand, and the opposite end of said levers incorporating means for quickly releasing said chips thereafter, said means comprising one of said levers having a magnet plate secured thereto and the other of said levers having a cardboard plate secured thereto, said plates being parallel and adjacent to each other when said handles are released, said handle having said cardboard plate secured thereto incorporating a hopper into which said chips drop.

* * * * *